US009326559B2

(12) United States Patent
Roban

(10) Patent No.: US 9,326,559 B2
(45) Date of Patent: May 3, 2016

(54) HOODED GARMENT

(76) Inventor: Andres Roban, Brooklyn, NY (US)

( * ) Notice: Subject to any disclaimer, the term of this patent is extended or adjusted under 35 U.S.C. 154(b) by 110 days.

(21) Appl. No.: 14/004,792

(22) PCT Filed: Mar. 14, 2012

(86) PCT No.: PCT/US2012/029014

§ 371 (c)(1),
(2), (4) Date: Oct. 2, 2013

(87) PCT Pub. No.: WO2012/125689

PCT Pub. Date: Sep. 20, 2012

(65) Prior Publication Data

US 2014/0366240 A1 Dec. 18, 2014

Related U.S. Application Data

(60) Provisional application No. 61/452,830, filed on Mar. 15, 2011.

(51) Int. Cl.

| | |
|---|---|
| ***A41D 23/00*** | (2006.01) |
| ***A42B 1/04*** | (2006.01) |
| ***A41D 3/08*** | (2006.01) |
| ***A41D 27/02*** | (2006.01) |
| ***A41D 1/00*** | (2006.01) |
| ***A41D 31/00*** | (2006.01) |

(52) U.S. Cl.

CPC . *A42B 1/048* (2013.01); *A41D 1/00* (2013.01); *A41D 3/08* (2013.01); *A41D 23/00* (2013.01); *A41D 27/02* (2013.01); *A41D 31/0016* (2013.01); *A42B 1/04* (2013.01); *A41D 2200/20* (2013.01)

(58) Field of Classification Search

CPC ..... A41D 2200/20; A41D 23/00–2023/008; A42B 5/00; A42B 1/045; A42B 1/048; A42B 1/24; A42B 1/241; A42B 1/248; A42B 7/00; A42B 1/006

See application file for complete search history.

(56) References Cited

U.S. PATENT DOCUMENTS

| | | | | | |
|---|---|---|---|---|---|
| 910,716 | A | * | 1/1909 | Neidhart | 2/204 |
| 971,476 | A | * | 9/1910 | Rostenberg | 2/204 |
| 1,061,991 | A | * | 5/1913 | Drullard | 2/204 |
| 1,073,345 | A | * | 9/1913 | Harris | 2/204 |
| 1,203,870 | A | * | 11/1916 | Houldsworth | 2/203 |

(Continued)

OTHER PUBLICATIONS

International Search Report issued Jun. 20, 2012, in connection with PCT Application No. US2012/029014.

*Primary Examiner* — Khaled Annis

(74) *Attorney, Agent, or Firm* — Lerner, David, Littenberg, Krumholz & Mentlik, LLP

(57) ABSTRACT

A garment is provided, having a hood for covering a head while exposing a face of a hooded user through a front periphery. The hood includes a collar portion which is circumferentially extending and is capable of wrapping about a neck of a user. The collar portion includes a neck periphery, which is circumferentially extending about a portion of the collar portion and is where the hood terminates, the neck periphery being capable of laying proximate to a nape of a user's neck. The collar portion includes a first circumferential end and an opposing second circumferential end. Extending downwardly from the first end of the neck periphery is a first panel and extending downwardly from the second end of the neck periphery is a second panel. The first and second panels are long and soft enough to lay on a torso and be selectively maneuvered about a user's face.

20 Claims, 6 Drawing Sheets

(56) References Cited

U.S. PATENT DOCUMENTS

| | | | | | |
|---|---|---|---|---|---|
| 1,316,778 | A * | 9/1919 | Ensten | 2/203 |
| 1,399,523 | A * | 12/1921 | Sable | 2/203 |
| 1,508,702 | A * | 9/1924 | Lark | 2/204 |
| 2,109,248 | A * | 2/1938 | Hibshman | 66/171 |
| 2,439,382 | A * | 4/1948 | De Grazla | 2/84 |
| 2,496,953 | A * | 2/1950 | Pinnere | 2/91 |
| 2,870,448 | A * | 1/1959 | Rosenthal | 2/91 |
| 3,555,566 | A * | 1/1971 | Gettinger | 2/204 |
| 4,110,846 | A * | 9/1978 | Hernandez | 2/203 |
| 5,086,629 | A * | 2/1992 | Dibrell | 62/259.3 |
| 5,115,517 | A * | 5/1992 | Ferguson et al. | 2/203 |
| 5,875,493 | A * | 3/1999 | MacDonald et al. | 2/172 |
| 6,189,152 | B1 * | 2/2001 | Lofton | 2/171 |
| 6,425,138 | B1 * | 7/2002 | Johnson | 2/202 |
| 7,251,840 | B2 | 8/2007 | Bayer | |
| 7,302,710 | B2 | 12/2007 | Thomas et al. | |
| 7,774,862 | B2 * | 8/2010 | Bjelland | 2/207 |
| 8,468,612 | B1 * | 6/2013 | Galloway | 2/207 |
| 8,726,421 | B2 * | 5/2014 | Alvarez | 2/207 |
| 2002/0095710 | A1 | 7/2002 | Lee | |
| 2003/0074717 | A1 * | 4/2003 | Robinson et al. | 2/204 |
| 2005/0039242 | A1 * | 2/2005 | Edmondson | 2/207 |
| 2007/0028359 | A1 * | 2/2007 | Robinson et al. | 2/171 |
| 2008/0115261 | A1 | 5/2008 | Grilliot et al. | |
| 2009/0205096 | A1 | 8/2009 | Seemann | |
| 2009/0235426 | A1 | 9/2009 | Johnston et al. | |
| 2010/0198323 | A1 * | 8/2010 | Jung | 607/109 |
| 2010/0299807 | A1 * | 12/2010 | Saito | 2/174 |
| 2010/0306898 | A1 | 12/2010 | Aurum | |
| 2011/0131704 | A1 * | 6/2011 | Hughes | 2/204 |
| 2012/0204323 | A1 * | 8/2012 | Park | 2/202 |

* cited by examiner

HOODED GARMENT

This application claims priority under 35 U.S.C. 119(e) of provisional patent application Ser. No. 61/452,830, filed Mar. 15, 2011 the contents of which are incorporated by reference in their entirety.

BACKGROUND OF THE DISCLOSED EMBODIMENTS

1. Field of the Disclosed Embodiments

The disclosed embodiments relate to hooded garments.

2. Description of the Related Art

Most people perspire when exercising in a gym. Towels are not always available. If they are available, they may not be easily towed and may not be desirable to use after being dropped on a dirty floor. In addition, a person's head can become cold when a person perspires in a gym. It is not convenient to wrap a person's head in a towel when exercising. Wearing a hooded sweatshirt would help, but a person could overheat. In addition, carrying keys or a music player around a gym can be troublesome. Pockets in a sweatshirt can be helpful, but as indicated, such a solution could cause uncomfortable overheating.

BRIEF SUMMARY OF THE DISCLOSED EMBODIMENTS

In view of the disclosed concerns, a garment is provided, which has a hood for covering a head while exposing a face of a hooded user through a front periphery. The hood includes a collar portion which is circumferentially extending and is capable of wrapping about a neck of a hooded user. The collar portion includes a neck periphery, which is circumferentially extending about a portion of the collar portion and is where the hood terminates, the neck periphery being capable of laying proximate to a nape of a hooded user's neck. The collar portion includes a first circumferential end and an opposing second circumferential end. Extending downwardly from the first end of the neck periphery is a first panel and extending downwardly from the second end of the neck periphery is a second panel. The first and second panels are long enough and soft enough to lay on a torso and be selectively maneuvered about a face of a hooded user.

BRIEF SUMMARY OF THE FIGURES

Certain embodiments of the invention will be described through the use of the accompanying drawings, which are not to be considered as limiting, and in which.

DETAILED DESCRIPTION OF THE EMBODIMENTS

Figure 1:
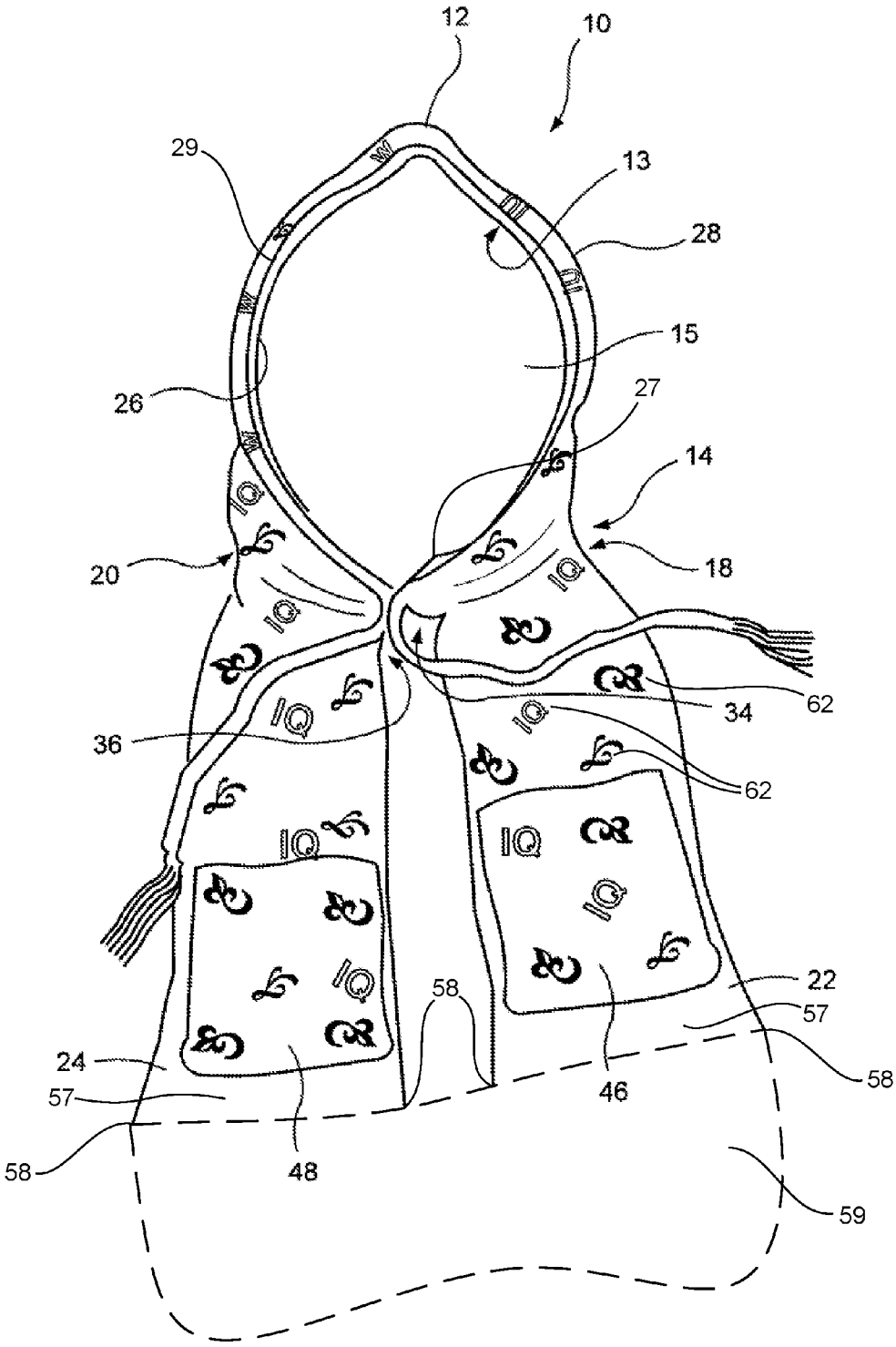
FIG. 1 illustrates a garment as it would appear on a hooded user.
Figure 5:
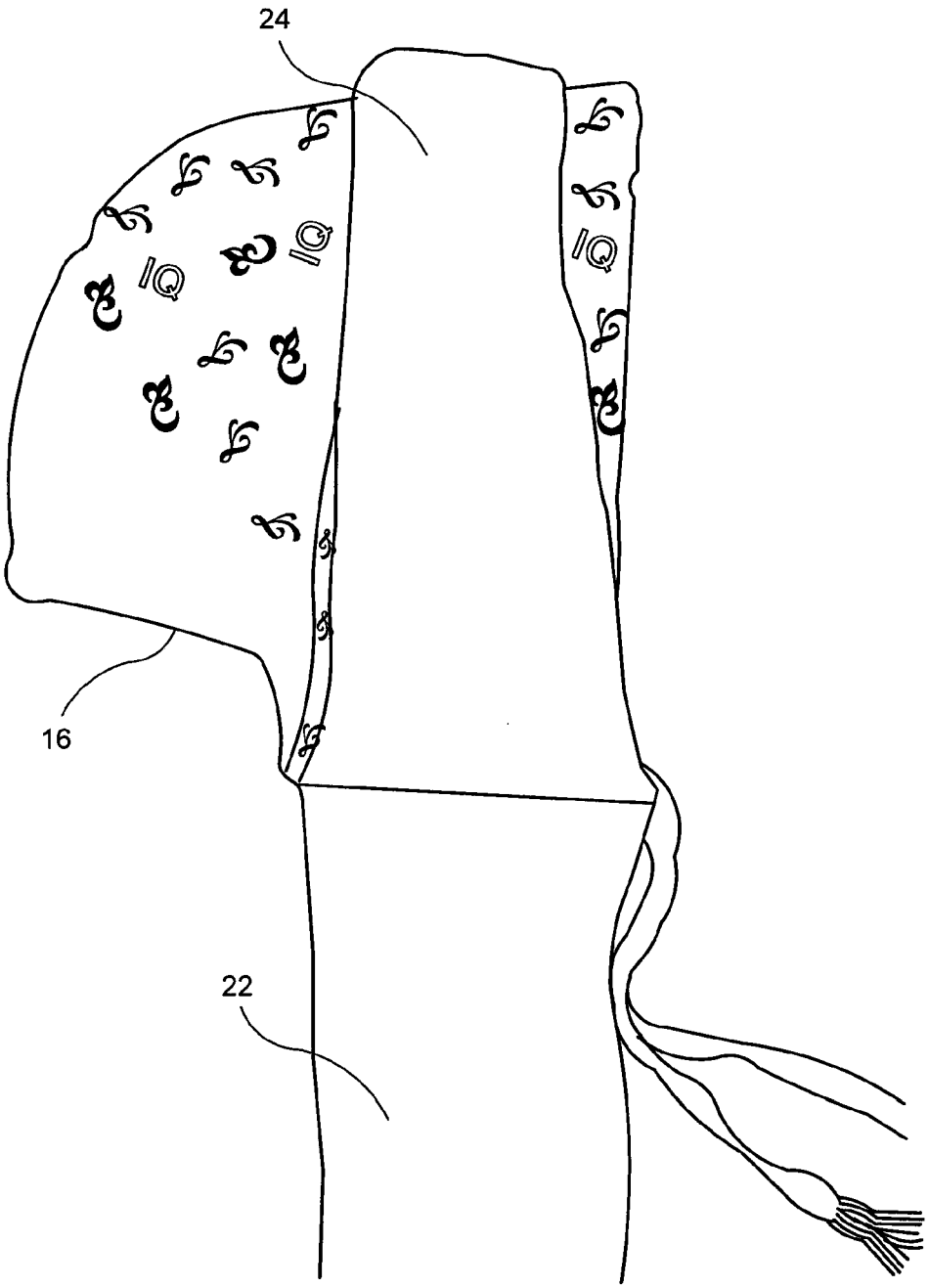
FIG. 5 further illustrates the garment laid out on a table, with the garment folded on its side and one extension panel folded upwardly to expose the inner lining.

FIG. 1 illustrates a garment 10 as it would appear on a hooded user. The garment includes a hood 12 for covering a head while exposing a face of a hooded user through a front periphery 13. The hood includes a collar portion 14 which is circumferentially extending, that is, about an effective cylindrical shape of a user's neck, and is capable of wrapping about a neck of a hooded user. The collar portion 14 comprises a neck periphery or edge 16 (see FIG. 5), which is circumferentially extending about a center of the collar portion 14 and is where the hood 12 terminates. That is, the hood is backless. The neck periphery is capable of laying proximate to a nape of a hooded user's neck. The collar portion includes a first circumferential end 18 and an opposing second circumferential end 20.

Extending downwardly from the first end 18 of the collar portion is a first panel 22, and extending downwardly from the second end 20 of the collar portion is a second panel 24. These panels can be considered, for example, left and right panels by reference to a user. The first and second panels 22, 24 are long enough and soft enough to lay on a torso and be selectively maneuvered about a face of a hooded user.

The garment is fabricated from an absorbent material. Accordingly, the garment can be use to absorb sweat from a user who is exercising at, for example, a gym. The absorbent material is, for example, cotton. The absorbent material can be manufactured to look and feel like a gym towel. Typically, both sides of the garment are absorbent, and one or both sides may be made from terry cloth or other absorbent material. The garment is therefore reversible.

Figure 2:
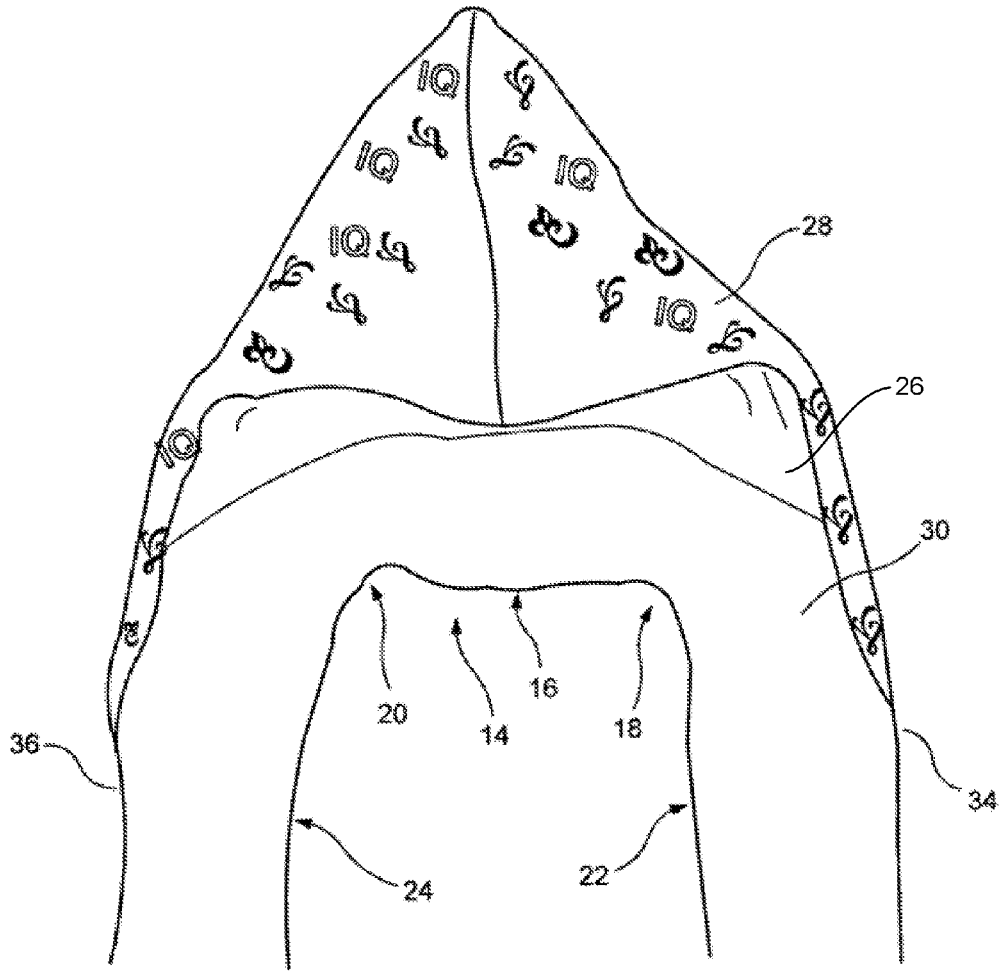
FIG. 2 illustrates the garment laid out on a table.
Figure 4:
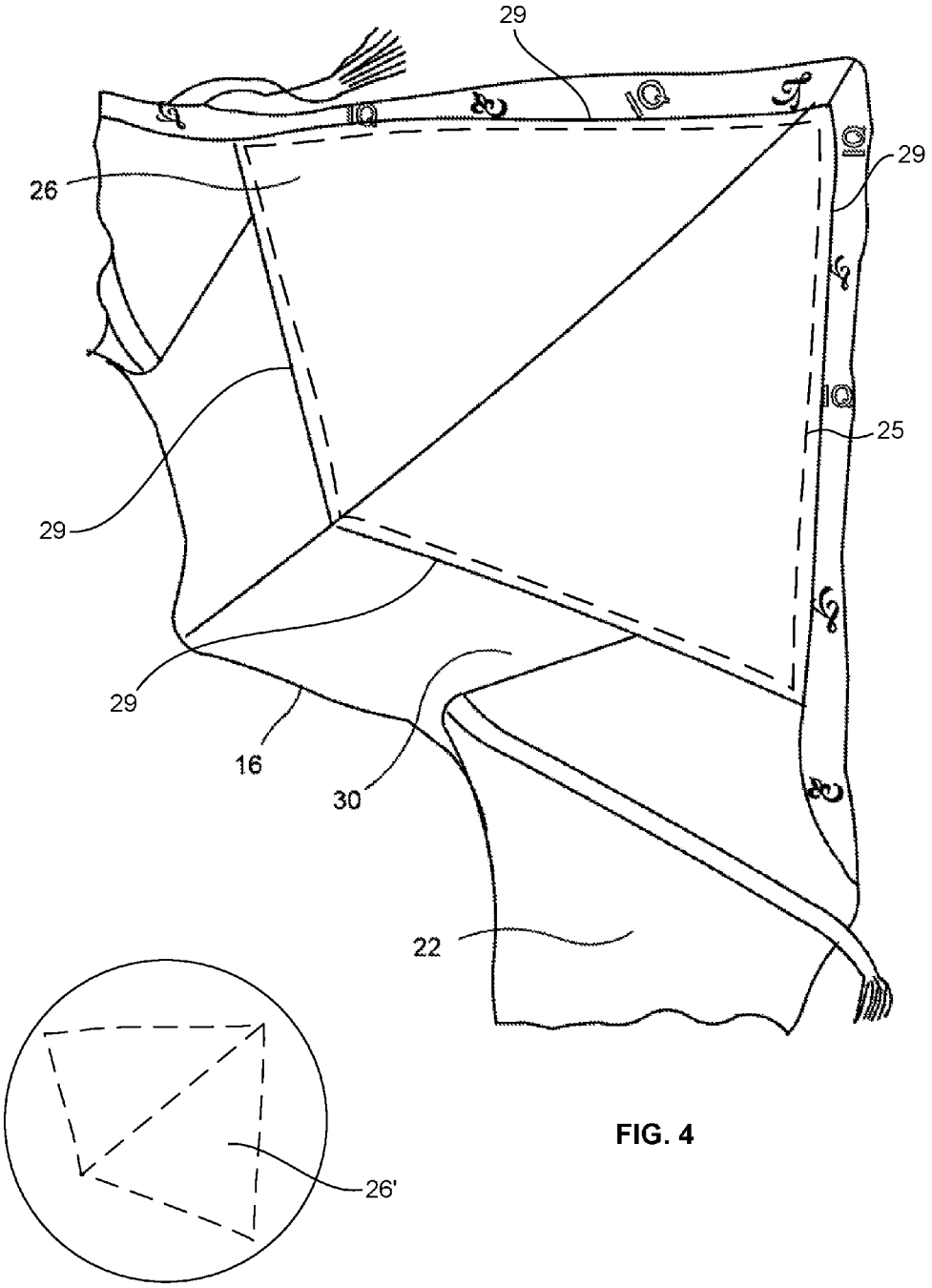
FIG. 4 further illustrates the garment laid out on a table, with the outer lining facing the table.

As illustrated in FIGS. 2 and 4, which illustrate the garment laid out on a table, the garment includes an inner lining 26 formed of the absorbent material and an outer lining formed of a second material. The outer lining 28 can be formed of a typical sweatshirt shell, such as cloth. Or an outdoor, wind and water resistant type shell can be utilized, providing additional versatility. In addition, a moisture barrier 25 (not shown and hidden under inner lining 26 is represented by hidden lines reference element 25) can be positioned between the inner lining 26 and the outer lining 28. Such the moisture barrier 25 would prevent sweat from soaking through the garment to the outer layer while being used by an exercising person.

The seam 29 between the inner 26 and outer 28 linings, running about the hood, can be sewn or releasably connected, via a zipper 27. In such a configuration, the inner lining 26 is removable from the garment. Especially with a moisture barrier 25 present, the outer lining 28 may remain fresh through a work out while the inner lining 26 becomes moist with perspiration and requires changing. In such an instance, the user can reuse the same outer lining 28 and replace the first inner lining 26 with a clean one or a second inner lining represented by hidden lines and element numeral 26' in FIG. 4. It would be apparent that packages of inner linings could be sold with one outer lining 28 and a plurality of inner linings 26, enabling switching the inner lining 26 as needed. In addition, just as with underwear packages having different colored underwear, packages containing the plurality of inner linings 26 can have inner linings 26 of differing colors.

As illustrated in FIGS. 2 and 4, an additional or second layer of absorbent material 30 is disposed about the collar portion 14 for absorbing more perspiration than the first absorbent material by itself. This is helpful when, for example, perspiration runs down one's head during an exercise program. The second layer of absorbent material can be the same material or a different material than the absorbent material used in the inner lining.

Figure 3:
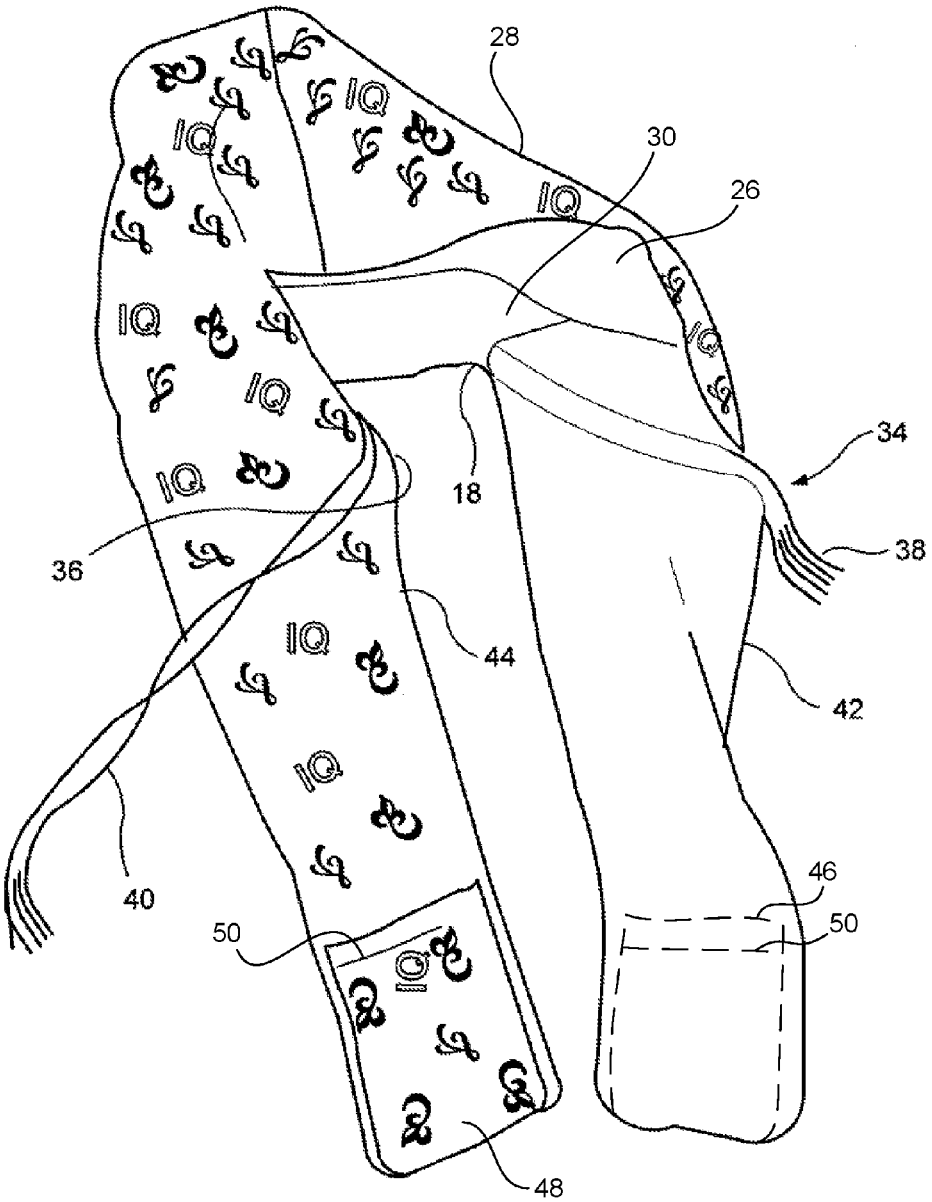
FIG. 3 further illustrates the garment laid out on a table.

As illustrated in FIGS. 1, 2 and 3, where FIG. 3 is a further illustration of the garment on a table, the hood front periphery includes a first circumferential end 34 and a second circumferential end 36. The first circumferential end 34 of the front periphery includes a first connecting implement 38 and the second circumferential end 36 of the front periphery includes a second connecting implement 40. Interconnecting the first and second connecting implements connects the circumferential ends of the front periphery. As illustrated, the connecting implements are respective ends of a drawstring. On the other hand, the connecting implements could be fasteners including, interlocking buttons, or Velcro elements, or the like.

When connected, an opening illustrated in FIG. 1 is formed to expose a face of a hooded user. In addition, when connected, the garment will not fall off a hooded user's body while exercising. A person can lay on an exercise mat without having the garment fall off. Or, a person can lay on an exercise bench without having the garment fall on a dirty floor. The hood will remain on a person's head so that perspiration will be absorbed by the garment and not spill onto a common exercise implement.

According to specific aspects of the disclosed design, as illustrated in FIG. 3, the first panel has a first front periphery 42 which is continuous with the first end of the hood front periphery. In addition, the second panel has a second front periphery 44 which is continuous with the second end of the hood front periphery. In addition, the panels are both substantially rectangular. Furthermore, the panels have a same width, each being between a quarter and a third of the circumferential length of the neck periphery.

Figure 6:
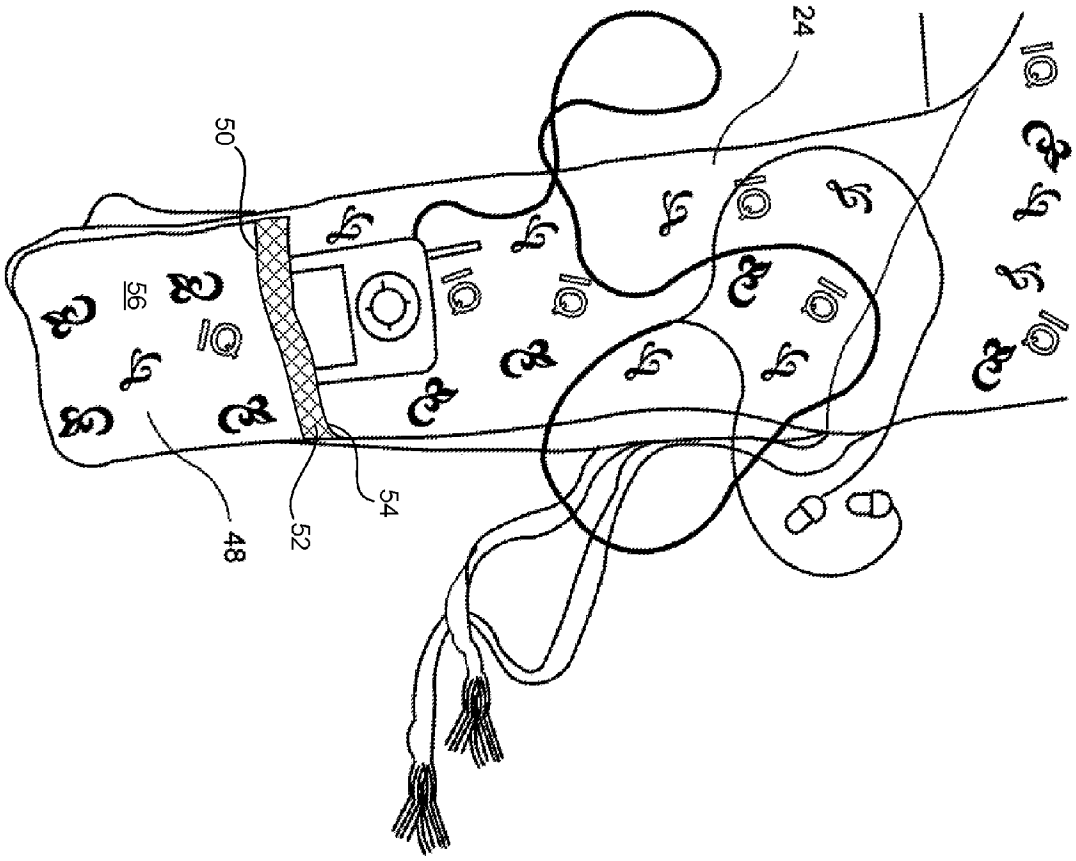
FIG. 6 further illustrates the garment laid out on a table with a music device in a panel pocket.

As illustrated in FIGS. 1 and 6, first panel includes a first outer pocket 46 and the second panel includes a second outer pocket 48. The panels provide for safeguarding personal items, for carrying personal effects such as Ipods and other mobile devices. Each outer pocket can be reclosable against the respective panels. For example, each outer pocket can include a zipper 50 enabling the reclosing function, as can be appreciated, with the garment secured about a user via the connecting elements 38, 40, a person's personal effects can be relatively confidently and securely held to a person's body.

In addition, each of the pockets 46, 48 can include a gripping surface 52, such as a neoprene mesh, on the inner surface 54 or outer surface 56 of the pocket. Such a gripping surface 52 enables gripping by a hooded user for manipulating each respective panel. Due to the gripping aspect, a person can insert their hands into the pockets and wipe their face, neck, back, exercise machines, etc. To provide for an optimal range of motion, the pockets can be in a lower region 57 of the panels, spaced from the hood. When the garment is reversed, the pockets can be used for wiping the user's face or for securing personal items.

In an alternative embodiment, the panels are long enough to connect to a hooded user's gym pants/shorts or underwear where either clothing article is designated as element numeral 59 in the drawings. Such a connection would be accomplished in a similar fashion to connecting suspenders to pants. Any type of a connector 58 used for suspenders, or connectors 58 otherwise referenced in this disclosure, as for example in paragraph [00018], could be used for this purpose.

In addition, it is conceivable that the at least one advertisement for goods and/or services could be positioned on an outside of one or both of the panels and/or an outside of the hood. For example, an incorporated gym, such as the known World Gym type, can provide the garment to users for free as a promotion of the gym. Alternatively, patterns or solid prints 62 of an individual and artistic nature can be provided on an outside of one or both of the panels and/or an outside of the hood.

The above represents non-limiting examples of the invention. One of ordinary skill would recognize equivalents for each discussed element and/or feature which fall within the scope of the invention.

I claim:

1. An exercise garment, comprising:

a reversible garment hood for head covering while face exposing a hooded user through a front periphery, the reversible garment hood is fabricated from a first layer of an absorbent material;

a collar portion included and integral with the hood, the collar portion is circumferentially extending for wrapping about the hooded user;

the collar portion comprising a neck periphery, which is circumferentially extending about a center of the collar portion and is where the hood terminates, the neck periphery is adapted to lay proximate to a nape of the hooded user;

the collar portion further includes a first circumferential end and an opposing second circumferential end; wherein the first layer comprises a removable inner lining and a reusable outer lining connected by a seam disposed about the hood;

a second layer of an absorbent material is disposed just about said collar portion for absorbing more perspiration than the first layer of the absorbent material on the reversible garment hood by itself;

a moisture barrier positioned between the inner lining and the outer lining for preventing perspiration of the hooded user from soaking through to the outer lining while exercising;

extending downwardly from the first circumferential end of the collar portion is a first panel, and extending downwardly from the opposing second circumferential end of the collar portion is a second panel;

the first and second panels are long and soft for laying on the hooded user's torso and for selective maneuverability about the hooded user by the hooded user;

a first outer pocket and a second outer pocket disposed on the first and second panels respectively, wherein each outer pocket is recloseable against the respective panels, and the first outer pocket and the second outer pocket further includes a gripping surface on an inner surface or an outer surface of the first and second outer pockets, the gripping surface for gripping by the hooded user and for manipulating each respective panel;

the first outer pocket and the second outer pocket are used for wiping the hooded user's face or for securing personal items, the panels safeguard personal items, and carry personal effects of the hooded user; and wherein, the first and second panels further include a lower region, the first and second panels are releasably connected at the lower region to gym pants or shorts of the hooded user.

2. The garment of claim 1, wherein the absorbent material of the first layer is cotton and the additional absorbent material of the second layer disposed about the collar portion is terry cloth.

3. The garment of claim 1, wherein the inner lining is formed of the absorbent material and the outer lining is formed of a second material.

4. The garment of claim 3, wherein the outer lining is formed of cloth or an outdoor wind and water resistant type shell.

5. The garment of claim 3, wherein the inner lining and outer lining are connected to each other via a zipper, whereby the inner lining is removable from the garment.

6. The garment of claim 5, further including a second inner lining and wherein the inner lining is a first inner lining and the second inner lining is zippered to the outer lining wherein the second inner lining is designed to replace the first inner lining if desired.

7. The garment of claim 6, wherein the first and second inner linings form a plurality of inner linings that are packaged together and wherein the second inner lining has a different color than the first inner lining.

8. The garment of claim 1, wherein the second layer of absorbent material about the collar portion is the same material or a different material than the rest of the garment's absorbent material.

9. The garment of claim 8, wherein:

the hood front periphery includes a first circumferential end of the front periphery and a second circumferential end of the front periphery;

the first circumferential end of the front periphery includes a first connecting implement and the second circumferential end of the front periphery includes a second connecting implement, wherein connecting the first and second connecting implements connect the circumferential ends of the front periphery.

10. The garment of claim 9, wherein the connecting implements are respective ends of a drawstring, or are fasteners including interlocking buttons, or hook and loop fastener elements.

11. The garment of claim 9, wherein the first panel has a first front periphery which is continuous with the first end of the hood front periphery and the second panel has a second front periphery which is continuous with the second end of the hood front periphery.

12. The garment of claim 1, wherein the panels are both substantially rectangular.

13. The garment of claim 12, wherein the panels have a same width, each being between a quarter and a third of the circumferential length of the collar portion for furthering security of the hooded garment on the hooded user while exercising so that when the hooded garment is connected the hooded user can lay on an exercise mat or exercise bench without having the garment fall off.

14. The garment of claim 1, wherein the first outer pocket and the second panel includes a second outer pocket are disposed in the lower region of the panels.

15. The garment of claim 14, wherein each of the outer pockets further includes a zipper for reclosing against the respective panels.

16. The garment of claim 1, further including a plurality of connecting implements to secure the garment about the hooded user.

17. The garment of claim 1, wherein the gripping surface is a neoprene mesh.

18. The garment of claim 1, wherein the first and second panels are long enough to connect with pants or underwear of a hooded user in a similar fashion as connecting suspenders to pants.

19. The garment of claim 1, wherein at least one advertisement for goods or services is positioned on an outside of one or both of the panels or an outside of the hood.

20. The garment of claim 1, wherein patterns or solid prints are provided on an outside of one or both of the panels or an outside of the hood.

* * * * *